US006390296B1

(12) United States Patent
Griffith et al.

(10) Patent No.: US 6,390,296 B1
(45) Date of Patent: May 21, 2002

(54) PACKAGING

(76) Inventors: Marty L. Griffith, 240 Ronner La., Winchester, VA (US) 22603; Alan T. Biggs, P.O. Box 185, Romney, WV (US) 26797

( * ) Notice: Subject to any disclaimer, the term of this patent is extended or adjusted under 35 U.S.C. 154(b) by 0 days.

(21) Appl. No.: 09/666,799

(22) Filed: Sep. 20, 2000

(51) Int. Cl.[7] ..... B65D 85/00
(52) U.S. Cl. ..... 206/320; 206/586; 206/592
(58) Field of Search ..... 206/326, 320, 206/586, 453, 592, 594, 523; 229/122.27, 122.31, 122.33

(56) References Cited

U.S. PATENT DOCUMENTS

| | | | | | |
|---|---|---|---|---|---|
| 2,277,674 | A | * | 3/1942 | Belsinger | 229/122.27 |
| 3,404,826 | A | * | 10/1968 | Carmody | 206/586 |
| 3,684,636 | A | | 8/1972 | Rothrock et al. | |
| 3,934,720 | A | * | 1/1976 | Kratochvil, Jr. | 206/521 |
| 4,030,600 | A | * | 6/1977 | Heaps | 206/386 |
| 4,122,946 | A | * | 10/1978 | Holley | 206/523 |
| 4,548,351 | A | * | 10/1985 | Gusic | 206/586 |
| 4,762,226 | A | | 8/1988 | Gatton | |
| 4,919,263 | A | | 4/1990 | Baltzer et al. | |
| 5,407,078 | A | | 4/1995 | Strauser | |
| 5,474,185 | A | | 12/1995 | Franke | |
| 5,769,233 | A | * | 6/1998 | Fredriks | 206/523 |
| 5,992,812 | A | * | 11/1999 | Mark | 248/345.1 |
| 6,092,651 | A | * | 7/2000 | Miller | 206/305 |

* cited by examiner

*Primary Examiner*—Shian Luong
(74) *Attorney, Agent, or Firm*—Siemens Patent Services

(57) ABSTRACT

The protection of items such as preassembled cabinets, furniture, major appliances or electronics against damage during shipping is a problem that has been approached in many different ways throughout the years. Manufacturers desire to pack their products as inexpensively, both in materials and labor, as possible while providing a maximum of protection against potential damage. This has typically entailed packing an item snugly in a preassembled carton, protected by systems such as styrofoam edge protectors. This procedure can, however, be quite awkward, especially with larger items such as furniture or cabinets. The present invention, however, offers a packaging system which can be built around the item to be packed, easing the packing procedure by employing a spacing lip along the lower edge of the bottom spacing pads which allow a packing sleeve to easily fit between the spacing pads and a bottom packing tray.

11 Claims, 2 Drawing Sheets

PACKAGING

BACKGROUND OF THE INVENTION

1. Field of the Invention

The present invention relates to commercial packing and shipping industry. More particularly, the invention comprises a system for packing items such as preassembled cabinets, furniture major appliances or electronics for shipping.

2. Description of the Prior Art

The protection of items such as preassembled cabinets, furniture, major appliances or electronics against damage during shipping has long been a concern, and many different solutions have been offered over the years.

U.S. Pat. No. 5,474,185, issued to Michael Franke on Dec. 12, 1995, discloses a PROTECTIVE PACKAGING FOR FURNITURE, ELECTRICAL APPARATUS AND THE LIKE, consisting of a fabric covering, generally fitted to the item to be packed, with padded reinforcement at the corner seams. Franke further presents a fabric covering with elastic inserts which allow or stretch to provide a snug fit over an object. Franke provides padding and corner protection for bulky items while the present invention provides rigid protection for all surfaces and corners.

U.S. Pat. No. 5,407,078, issued to Burford R. Strauser on Apr. 18, 1995, discloses a PERIMETER PACKAGE FOR ARTICLES, wherein a rigid, stackable frame of corrugated and honeycombed cardboard is used for shrink or stretch wrapping an item, such as furniture, or other bulky items. Strauser's frame is cut from a sheet of corrugated cardboard and folded such that support columns are formed in piece. Honeycombed cardboard buffers are foldably mounted at the top and bottom of each piece to form a rigid stacking surface for the frame. Strauser provides an excellent framework for shrink or stretch wrapping of bulky items while the present invention provides corner bracing for protecting an item on a cardboard shipping box.

U.S. Pat. No. 4,919,263, issued to Donald L. Baltzer, et. al., on Apr. 24, 1990, discloses a CONTAINER PACKAGING for large pieces of furniture, wherein multi-ply corrugated cardboard is scored and folded to form a pallet upon which a piece of furniture is placed and into the legs of the piece project. Separate corrugated corner posts fit around the corners of the piece of furniture and mount within the pallet and a separate corrugated top piece. The entire structure is then overwrapped for shipping. Baltzer has the convenience of being expandable along its length to receive larger furniture pieces by adding extension member to the pallet base, thus requiring fewer stock packaging containers but, although corners and top are protected, surfaces faces of the furniture piece are exposed. The present invention, on the other hand, provides full protection to the shipped piece.

U.S. Pat. No. 4.762,226, issued to John R. Gatton, on Aug. 9, 1988, discloses a SHIPPING CONTAINER FOR MAJOR APPLIANCES, a corrugated container having a bottom cap with flaps glued to the lower edges of the walls of a tube member and a top cap with flaps on three sides, similarly glued to the upper edge of the walls of the tube member. The fourth side of the top cap is secured to the fourth wall of the tube member by a triple folded flange, allowing a lifting point for lifting equipment. In Gatton the walls of the container are in direct contact with the item packed within, whereas the present invention provides a spacer to provide a gap between the walls of the shipping container and the item packed within.

U.S. Pat. No. 3,684,636, issued to Harry E. Rothrock, Jr., et. al., on Aug. 15, 1972, discloses a PAPER BOARD CORNER PACKING CONSTRUCTION, wherein corrugated cardboard is folded and cut in such a manner as to provide a rigid, cushioning corner assembly for insulating the corners of a packed item from contact with the walls of the shipping container, typically a corrugated cardboard box. In Rothrock, the cut and folded corner packing construction is placed around the perimeter of the bottom of the shipping container, placing the item to be shipped into the corner packing construction, and then placing additional corner packing construction around the top perimeter of the shipping container to protect the top of the item to be shipped. The present invention, on the other hand, makes it easier to construct the shipping container around the item to be shipped rather than inserting the item into the shipping container.

None of the above inventions and patents, taken either singly or in combination, is seen to describe the instant invention as claimed.

SUMMARY OF THE INVENTION

The protection of items such as preassembled cabinets, furniture, major appliances or electronics against damage during shipping is a problem that has been approached in many different ways throughout the years. Manufacturers desire to pack their products as inexpensively, both in materials and labor, as possible while providing a maximum of protection against potential damage. This has typically entailed packing an item snugly in a preassembled carton, protected by systems such as styrofoam edge protectors. This procedure can, however, be quite awkward, especially with larger items such as furniture or cabinets. The present invention, however, offers a packaging system which can be built around the item to be packed, easing the packing procedure.

Accordingly, it is a principal object of the invention is to provide a packing system that is economical to produce.

It is another object of the invention to provide a packing system that is easy to use.

It is a further object of the invention to provide a packing system that provides substantial protection to an item in transit.

Still another object of the invention is to provide a packing system chat is easily scored until use.

An additional object of the invention is to provide a packing system that is easy to unpack.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
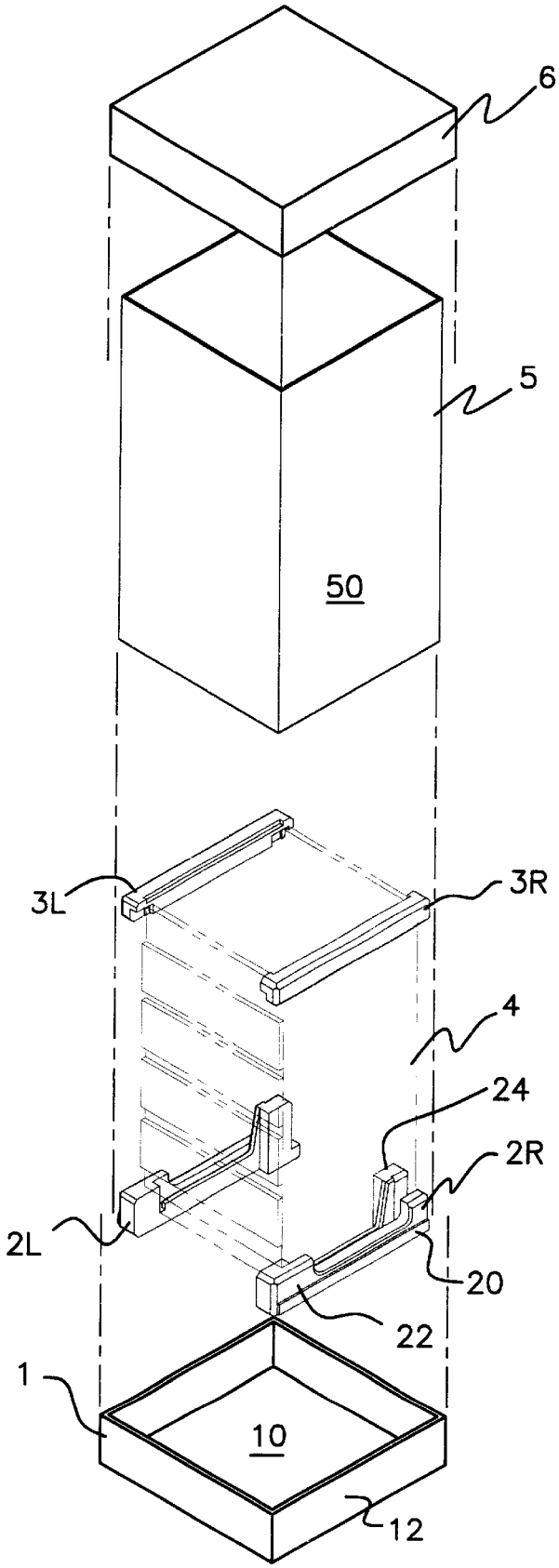
FIG. 1 is an exploded environmental perspective of the invention in use.

FIG. 1 depicts the invention in an exploded, perspective view with bottom tray 1, bottom spacer pads 2R (right) and 2L (left), top spacer pads 3R (right) and 3L a(left), packed object 4, packing sleeve 5, and top tray 1 (bottom tray 1 and top tray 1 being identical). Bottom spacer pads 2R and 2L and top spacer pads 3R and 3L are of a material such as molded foam, while top and bottom trays 1 and packing sleeve 5 are of a material such as heavy corrugated cardboard, although it would be evident to one skilled in the art that other materials could be used just as effectively.

It would be further evident to one skilled in the art that top and bottom trays 1 can be cut from a flat blank and stored flat until use, at which t me they are folded to their configuration for use. Packing sleeve 5 can likewise be stored flat until use by folding along opposite corners.

Figure 2:
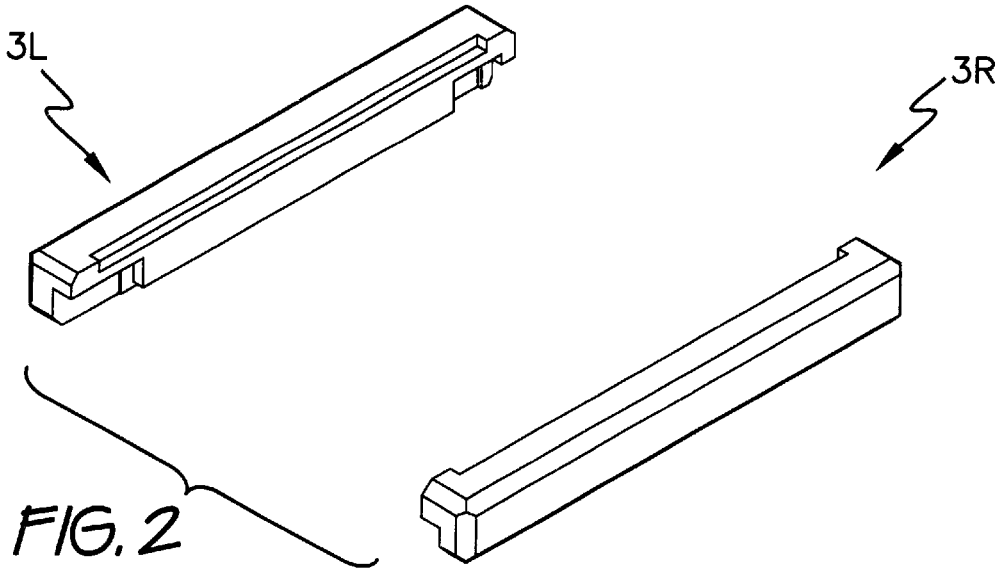
FIG. 2 is a perspective view of a typical pair of top spacer pads of the invention.
Figure 3:
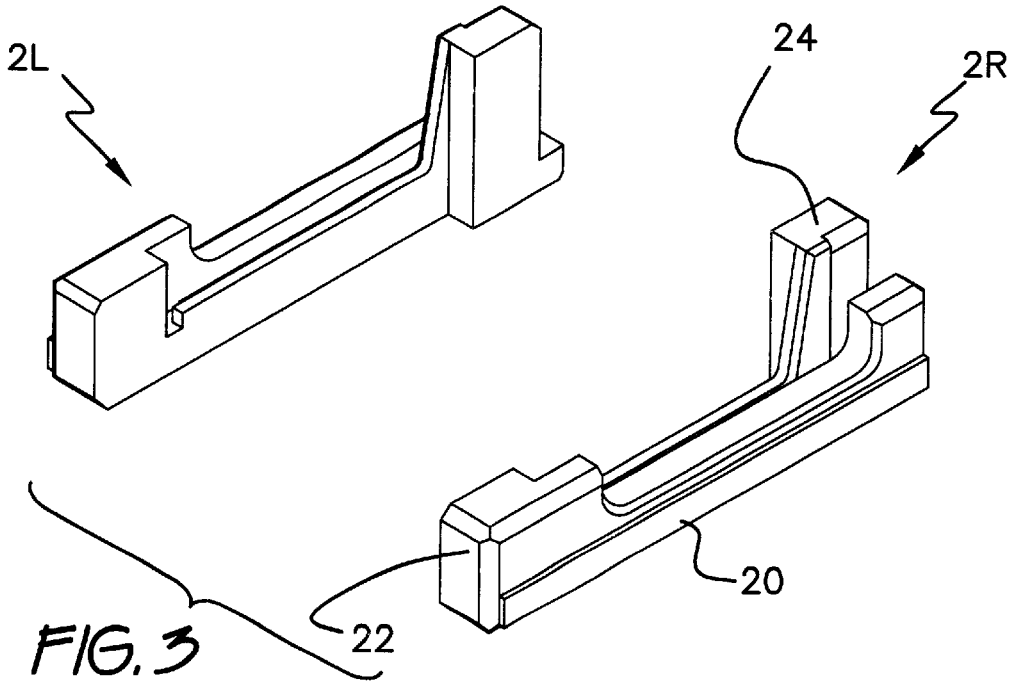
FIG. 3 is a perspective view of a typical pair of bottom spacer pads of the invention.

In typical packing configurations of similar sort, bottom and top spacers are dimensioned such that, when fitted to a packed item, both fit snugly inside of a single piece packing container or packing sleeve similar to that shown in FIG. 1. In the present invention, bottom spacer pads 2R and 2L are dimensioned such that when fitted to a packed item 4 they fit snugly within bottom tray 1. Differing from typical systems, however, the present invention has a spacing lip 20, as shown in FIG. 3, situated along the lower length of bottom spacer pads 2R and 2L which provides a gap between the bottom spacing body 22 of bottom spacer pads 2R and 2L and the tray walls 12 of bottom tray 1 such that sleeve sides 50 of packing sleeve 5 easily slip between tray walls 12 of bottom tray 1 and bottom spacing body 22 of bottom spacer pads 2R and 2L, resting on spacing lips 20 of bottom spacer pad 2R and 2L. Top spacer pads 3R and 3L, FIG. 2, are, in turn, dimensioned such that when fitted to packed item 4 they fit snugly within the inner dimensions of packing sleeve 5, securing packed item 4 in place. A top tray 1 is then fitted over packing sleeve 5 and secured with straps or tape. It will be recognized by those skilled in the packaging arts that a wide variety of strapping materials and tapes are available which are suitable for securing packaging components, such as those of the present invention, to one another. FIG. 1 shows one possible location for strapping 62 as well as one possible set of locations for tape 60. Other arrangements and configurations such as are well known in the art could, likewise, be used. Also, typically, only one or the other securing method would be used on any given package as is well known in the art.

In packing of pre-assembled cabinetry, where the floor of the cabinet usually has no solid rear support, a rear support foot 24 provides support to the rear of the cabinet's floor. It would be evident to one skilled in the art that similar support could be provided in other critical areas, as needed.

The advantage of the present invention over typical packing systems is that due to spacing lip 20, as shown in FIG. 3, bottom spacer pads 2R and 2L are automatically situated to receive packing sleeve 5, where in typical packing systems bottom spacer pads 2R and 2L must be precisely situated to receive packing sleeve 5 or bottom spacer pads 2R and 2L must be slid through packing sleeve 5, along with packed item 4, either of which is a much more precise maneuver than required by the present invention.

It is to be understood that the present invention is not limited to the embodiments described above, but encompasses any and all embodiments within the scope of the following claims.

We claim:

1. A packaging system comprising;

a bottom tray, comprising:
a bottom and
four walls, a packing sleeve, having
four sides dimensioned to fit inside of said four walls of said bottom tray, said four sides having a substantially uniform thickness, a right and a left bottom spacer pad designed to receive the bottom edges of an item to be packed and dimensioned to fit inside of said our sides of said packing sleeve, said right and left bottom spacer pads each comprising a spacer lip disposed along a lower longitudinal outside edge thereof, said lip being dimensioned to provide a gap between said outside, longitudinal edges and an inside surface of said walls of said bottom tray, said gap being substantially equal to said thickness of said sides of said sleeve, a right and a left top spacer pad designed to receive the top edges of an item to be packed and dimensioned to fit inside of said four sides of said packing sleeve, an item to be shipped, and a top tray, identical to said bottom tray and dimensioned to fit over said packing sleeve.

2. A packaging system, as defined in claim 1, wherein said bottom tray, said packing sleeve, and said top tray are produced out of corrugated cardboard.

3. A packaging system, as defined in claim 1, wherein said bottom spacing pads and said top spacing pads are produced out of a foam material.

4. A packing system comprising;

a bottom tray, having
a bottom and
four walls folded upwards from said bottom, a pair of a right and a left bottom spacer pad, each having
a main body portion, and
a spacing lip along an outer length of each of said main body portions,
said right and left bottom spacing pads designed to receive the bottom edges of an item to be packed into said main body portion and dimensioned such that when placed within said bottom tray, said spacing lips fit snugly against said walls of said bottom tray, a packing sleeve, having
fours sides dimensioned to
fit snugly inside of said four walls of said bottom tray,
rest on said spacing lips of said right and left bottom spacer pads, and
fit snugly around said main body portions of said right and left bottom spacing pads, a pair of a right and a left top spacer pad designed to receive the top edges of an item to be packed, and fit snugly within said four walls of said packing sleeve, and a top tray, identical to said bottom tray, dimensioned to fit snugly over said packing sleeve.

5. A packaging system, as defined in claim 4, wherein said bottom tray, said packing sleeve and said top tray are produced out of corrugated cardboard.

6. A packaging system, as defined in claim 4, wherein said right and left bottom spacing pads and said right and left top spacing pads are produced out of a foam material.

7. A method for packaging, in combination with an item to be packed, comprising;

folding a pre-cut and pre-scored blank to form a bottom tray, having a bottom, and four sides, fitting a pair of a right and a left bottom spacing pads onto the bottom edges of an item to be packed, said right and left spacing pads having a main body portion to receive the bottom edges of the item to be packed, and a spacing lip along a lower, outside edge of said main body portion, providing a gap between said main body portion and said walls of said bottom tray, placing the bottom of said item to be packed, fitted into a pair of a right and a left bottom spacing pad, into said bottom tray such that said spacing lips are fit snugly against said walls of said bottom tray, placing a packing sleeve over said item to be packed, said packing sleeve having fours sides dimensioned to fit snugly inside of said four walls of said bottom tray, rest on said spacing lip of said right and left bottom spacer pads, and fit snugly around said main body portions of said right and left bottom spacing pads, fitting a pair of a right and a left top spacing pad over the top edges of said item to be packed and inside of the said four sides of said packing sleeve, said right and left top spacing pads being dimensioned to it snugly between said top edges of said item to be packed and said sides of said packing sleeve, placing a top tray, identical to said bottom tray, over said packing sleeve, said top tray fitting snugly over said packing sleeve.

8. A method for packaging, in combination with an item to be packed, as defined in claim 7, wherein the assembly of said packaging is secured with tape.

9. A method for packaging, in combination with an item to be packed, as defined in claim 7, wherein the assembly of said packaging is secured with packing straps.

10. A method for packaging, in combination with an item to be packed, as defined in claim 7, wherein said bottom tray, said packing sleeve, and said top tray are produced out of corrugated cardboard.

11. A method for packaging, in combination with an item to be packed, as defined in claim 7, wherein, said right and left bottom spacing pads, and said right and left top spacing pads are produced out of a foam material.

* * * * *